US008655249B2

(12) United States Patent
Barton et al.

(10) Patent No.: US 8,655,249 B2
(45) Date of Patent: Feb. 18, 2014

(54) APPARATUS, SYSTEMS, AND METHODS FOR BELT-ROLL FUSER LATCHING

(75) Inventors: Augusto E. Barton, Webster, NY (US); Paul M. Fromm, Rochester, NY (US); William A. Burton, Fairport, NY (US); Stephen B. Williams, Marion, NY (US); Brian J. Dunham, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 486 days.

(21) Appl. No.: 13/010,345

(22) Filed: Jan. 20, 2011

(65) Prior Publication Data

US 2012/0189969 A1 Jul. 26, 2012

(51) Int. Cl.
*G03G 15/20* (2006.01)

(52) U.S. Cl.
USPC ..... 399/330; 432/228; 432/246; 432/59; 432/60; 399/122; 399/329; 399/331

(58) Field of Classification Search
CPC ..... G03G 15/20; G03G 15/2067; G03G 15/2035; G03G 15/2032; G03G 15/2017; G03G 15/2014; G03G 15/2003; G03G 15/2071; G03G 15/2089
USPC ..... 432/59, 60, 8, 228, 246; 399/122, 329, 399/330–331
See application file for complete search history.

(56) References Cited

U.S. PATENT DOCUMENTS

| | | | | |
|---|---|---|---|---|
| 6,059,238 | A * | 5/2000 | Reynolds et al. | 248/118 |
| 6,487,389 | B2 * | 11/2002 | Jia et al. | 399/327 |
| 6,540,470 | B2 * | 4/2003 | Smith et al. | 414/430 |
| 6,549,739 | B2 * | 4/2003 | Dettinger et al. | 399/122 |
| 6,918,272 | B1 * | 7/2005 | Sanders | 70/58 |
| 7,367,597 | B2 * | 5/2008 | Rechberg | 292/304 |
| 7,817,950 | B2 * | 10/2010 | Burton et al. | 399/323 |
| 8,249,486 | B2 * | 8/2012 | Onodera et al. | 399/122 |
| 8,269,810 | B2 * | 9/2012 | Saiki | 347/238 |
| 8,447,218 | B2 * | 5/2013 | Yamana | 399/329 |
| 2005/0249532 | A1 * | 11/2005 | Bailey et al. | 399/328 |
| 2010/0215420 | A1 * | 8/2010 | Komiyama et al. | 399/400 |
| 2010/0237111 | A1 * | 9/2010 | Mroczka | 224/156 |
| 2011/0135341 | A1 * | 6/2011 | Kamiya et al. | 399/122 |
| 2011/0177449 | A1 * | 7/2011 | Tanaka et al. | 430/117.1 |

* cited by examiner

*Primary Examiner* — Steven B McAllister
*Assistant Examiner* — Ko-Wei Lin
(74) *Attorney, Agent, or Firm* — Ronald E. Prass, Jr.; Prass LLP

(57) ABSTRACT

A belt-roll fuser system includes a belt-roll fuser module that is movable to engage and disengage to a main frame of the belt-roll fuser system. The belt-roll fuser has an internal pressure member that defines a fusing nip with an external pressure member of the main frame when the belt-roll fuser module is engaged. The belt-roll fuser module is movable by a latch, and when engaged, a nip load path crosses through a point at which the latch attaches to the belt-roll fuser module.

12 Claims, 4 Drawing Sheets

APPARATUS, SYSTEMS, AND METHODS FOR BELT-ROLL FUSER LATCHING

FIELD OF DISCLOSURE

The disclosure relates to methods, apparatus, and systems for belt-roll fuser latching. Specifically, the disclosure relates to belt-roll fuser module latch methods and systems that reduce belt-roll fuser frame twisting and deformation, and accommodate effective fuser belt tracking.

BACKGROUND

Related art belt-roll fuser latching systems may include a latching mechanism with a single attachment and/or pivot point. The belt-roll fuser module is latched to a main frame of the belt-roll fuser system to engage pressure rolls that together define a fuser nip. In related art systems, the attachment point is not aligned with a pressure roll nip load vector. Such an arrangement may cause belt module twist and frame deformation and compromise fuser belt tracking, the belt-fuser system being highly sensitive to mis-alignments of belt rolls and frame distortion. A related art method of preventing misalignment includes adding torsional stiffness to the belt module to limit belt module twist and comply with alignment requirements.

SUMMARY

Effective and cost-efficient belt-roll fuser systems that maintain critical roll-to-roll alignment, accommodate effective belt tracking, and allow belt-roll fuser components to be easily serviced are desired.

In an exemplary embodiment, a belt-roll fuser system may include a belt-roll fuser module, the system comprising a belt-roll fuser main frame, the main frame having an external pressure member. The belt roll fuser module may include an internal pressure member and at least one heated belt-entraining member, the belt roll fuser module being movable to engage and disengage the internal pressure member with the external pressure member of the belt-roll fuser main frame, wherein the internal pressure member and the external pressure member define a nip in the engaged position. The belt-roll fuser module may include at least one latch point at which the module and the main frame are latched in the engaged position. A latch member for moving the belt-roll fuser module to disengage and engage the internal pressure member and external pressure member may be attached at the latch point, wherein the latch point is located in a path of a load vector of the nip when the internal pressure member is engaged with the external pressure member.

In an exemplary embodiment, a customer serviceable belt-roll fuser may include a belt-roll fuser main frame having an external pressure member that is customer replaceable. The customer serviceable belt-roll fuser may include a belt-roll fuser module having an internal pressure member, a belt member, a cleaner member, and a tension member, at least one of the belt member, the cleaner member, and the tension member being heated, the belt-roll fuser module being configured to engage the belt-roll fuser main frame, wherein when the belt-roll fuser module is engaged to the belt-roll fuser main frame, the internal pressure member and the external pressure member define a fusing nip. A latch may be used to engage the belt-roll fuser module to the belt-roll fuser main frame, the latch being attached to the belt-roll fuser module at a latch point. The latch point is located at about a central longitudinal axis of the internal pressure member.

In an exemplary embodiment, a belt-roll fuser module latching method for engaging an internal pressure member of a belt-roll fuser module with an external pressure member of a belt-roll fuser main frame to define a fusing nip may include latching a belt-roll fuser module to the main frame at a latching point. The latching point may be located on about a longitudinal axis of the internal pressure member. Specifically, the latching point may be located at about a central longitudinal axis of the internal pressure member. In alternative embodiments, the latching point may be located at any point whereby a nip load path crosses through the latch point, i.e., the latching point is in the nip load path.

Exemplary embodiments are described herein. It is envisioned, however, that any system that incorporates features of methods, apparatus, and systems described herein are encompassed by the scope and spirit of the exemplary embodiments.

DETAILED DESCRIPTION

Figure 1:
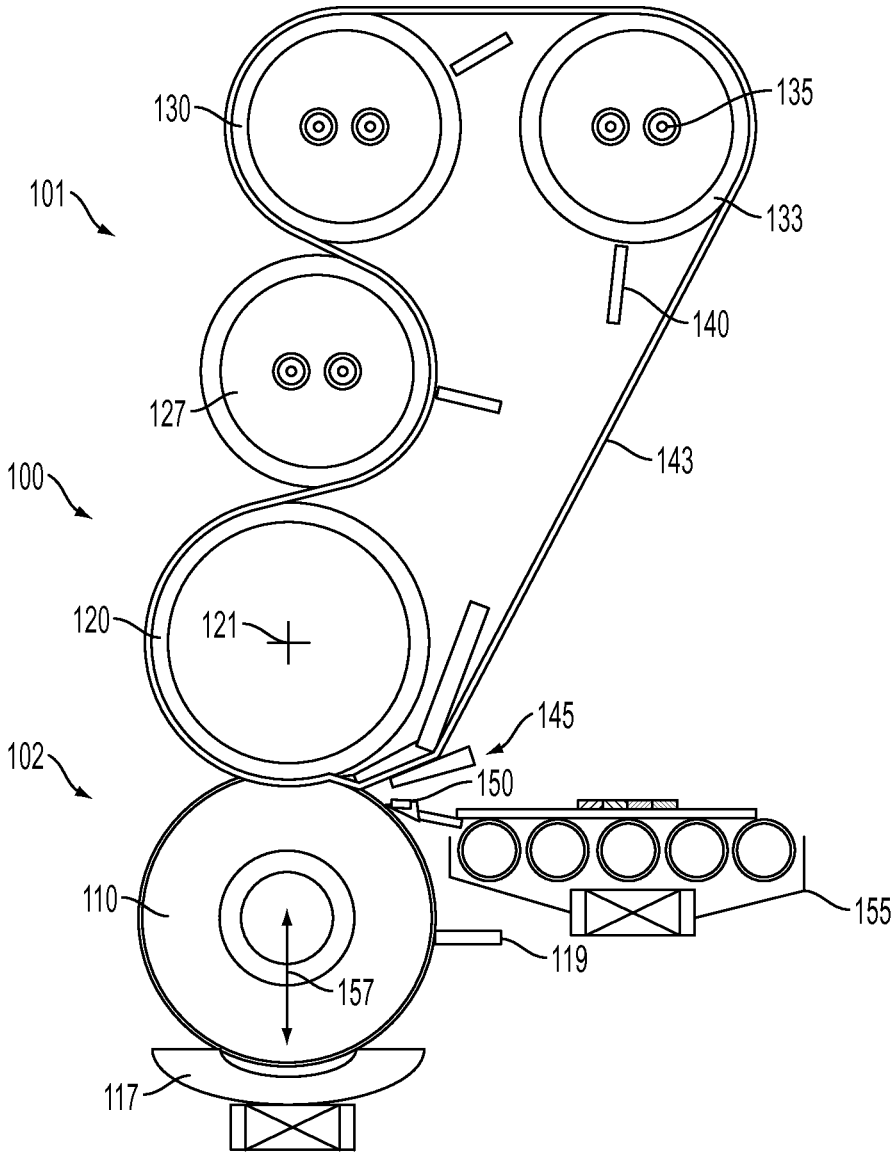
FIG. 1 shows a diagrammatical side view of a belt-roll fuser module having an interior pressure member engaged with an external pressure member of a belt-roll fuser main in accordance with an exemplary embodiment.

Exemplary embodiments are intended to cover all alternatives, modifications, and equivalents as may be included within the spirit and scope of the methods, apparatus, and systems as described herein.

Reference is made to the drawings to accommodate understanding of methods, apparatus, and systems for latching a belt-roll fuser module to a belt-roll fuser mainframe of a belt-roll fuser system. In the drawings, like reference numerals are used throughout to designate similar or identical elements. The drawings depict various embodiments and data related to embodiments of illustrative apparatus, systems, and methods for latching a belt-roll fuser module to a belt-roll fuser main frame.

Apparatus and systems of embodiments may include systems for printing images on substrates by fusing to the substrates a marking material. Exemplary substrates may include media webs, such as a paper webs. Alternatively, the system may be configured to feed cut sheets to a fixing or fusing nip of the belt-roll fuser.

Related art belt-roll fuser systems are sensitive to misalignment of belt members, such as belt rolls, which compromises fuser belt tracking. Related art belt-roll fuser systems are also sensitive to frame distortion misalignment. For example, related art systems may have a belt-roll fuser module with a latching point that is not located along an axis of a pressure member. Such a configuration leads to twisting of the belt-roll fuser module, which can lead to misalignment. Related art methods of addressing this issue include adding an amount of torsional stiffness to the belt module to limit twist of the frame.

Accordingly, methods of embodiments include latching a belt-roll fuser module to a belt-roll fuser main frame at a single latching point that is located along an axis of a pressure member. Specifically, embodiments include latching the belt-roll fuser module on a longitudinal axis of an internal pressure member. In embodiments of methods, apparatus, and systems, an internal pressure member of a belt-roll fuser module may lack a heat lamp. The belt-roll fuser module may be provided heat by at least one of a plurality of members entraining the fuser belt. For example, the plurality of members may include a cleaner member, a belt member, and a steering member for maintaining belt alignment by, e.g., preventing the belt from "walking" toward either side of the belt-roll fuser module. Any one or more of the plurality of members may be heated. As such, the internal pressure member may be configured so that it is not heated, and/or the internal pressure member does not include a heat lamp or other heat source, and the module may be latched on the internal pressure member axis.

It has been found that strict tolerances are required to maintain proper tracking control in belt-roll fusers. While a belt-fuser system having a movable belt-roll fuser module is advantageous for serviceability, latching the module to the system main frame at a point that does not cross the nip load path may result in frame distortion, making proper tracking ever more difficult. As such, a belt-roll fuser module in accordance with an exemplary embodiment may include an internal pressure member that engages an external pressure member of a belt-fuser main frame when the belt-fuser module is latched to the main frame, i.e., when the belt-roll fuser module is positioned so that the internal pressure member of the belt-roll fuser defines a nip with the external pressure member of the belt-fuser main frame. The belt-roll fuser module may be configured to unlatch from the belt-fuser main frame to allow the internal pressure member and other components of the module to separate from the main frame. Such an arrangement renders a belt-roll fuser easily serviceable.

The belt-roll fuser module may include other members that facilitate entraining of the fuser belt, cleaning, tracking, etc. Other members may include, for example, a cleaner roll, a belt roll, and a steering roll. Each of the members and the internal pressure member may include a central longitudinal axis, e.g., an axis about which a cylindrical roll rotates, or a rotational axis. To ensure proper tracking control, axes of the members must be kept within strict tolerances.

When a moveable belt-roll fuser module is positioned to latch to the main frame, and the internal pressure member is engaged with the external pressure member to define a fusing nip, a frame of the belt roll fuser may twist or distort. The twisting may result from a nip load creating a moment. The twisting may cause misalignment that is significant enough to, e.g., prevent the steering member from effectively steering the walking fuser belt, even if the steering member is optimized to use its largest steering angle. With such significant misalignment produced by frame twisting, it may be even more difficult to adequately address misalignment that derives from sources other than latching the belt-fuser module to the main frame. Accordingly, belt module twisting and/or frame distortion may eliminate tracking altogether.

Nonetheless, a belt-roll fuser having a module that latches and unlatches to a main frame of the fuser is advantageous for, e.g., its serviceability. A user may service a belt-roll fuser having a belt-roll module by unlatching the module so that is may separate from the main frame of the belt-roll fuser system. The module may separate to provide access to components of the belt-roll fuser. For example, the external pressure member may be replaceable. Also, the internal pressure member of the belt-roll fuser module may be replaceable, as well as the fuser belt. Other components of the belt-roll fuser system may be replaceable, such as a web cleaning system located adjacent to a cleaning member of the belt-roll fuser module. The belt-roll fuser system is configured so that a belt-roll fuser module may unlatch and disengage from a main frame of the belt-roll fuser system to accommodate access to one or more of the above-mentioned replaceable components, among others, and enable other services that the belt-roll fuser system may need.

A belt-roll fuser system in accordance with an exemplary embodiment is shown in FIG. 1. Specifically, FIG. 1 shows a belt-roll fuser system 100. The belt-roll fuser system 100 may include a belt-roll fuser module 101. The belt-roll fuser module 101 may be configured to latch to and unlatch from a main frame portion 102 of the belt-roll fuser system 100. The belt-roll fuser main frame 102 may include an external pressure member 110, and the belt-roll fuser module 101 may include an internal pressure member 120. When the belt-roll fuser module is in a latched position, i.e., when the belt-roll fuser module 101 is latched to the main frame 102, the internal pressure member 120 may be engaged with the external pressure member 110 to define a fusing nip. When the belt-roll fuser module 101 is unlatched from the main frame 102, the belt-roll fuser module 101 may be separated from the main frame 102 whereby access may be accommodated for, e.g., servicing or replacing components of the belt-roll fuser system 100.

The external pressure member 101 may be removable. Accordingly, when the belt-fuser module 101 is separated from the belt-roll fuser main frame 102, the external pressure member 110 may be accessed for cleaning and/or servicing. For example, the external pressure member 110 may be customer replaceable.

The external pressure member 110 may be associated with a pressure roll cooling system. For example, FIG. 1 shows a pressure roll cooling system 117 positioned below an external pressure member 110. A pressure member monitoring device 119 may be included and configured for monitoring the pressure member 110. For example, monitoring device 119 may be a thermistor, such as a contact thermistor.

As shown in FIG. 1, the internal pressure member 120 may be engaged with the external pressure member 110 to form a fusing nip. The fusing nip may be formed when the belt-roll module 101 is latched to the main frame 102 of the belt-roll fuser system 100.

The belt-roll fuser module 101 may include a plurality of belt members. The belt members may be rotatable about an axis, e.g., a longitudinal access, to facilitate movement of a fuser belt. The belt members may be rolls that support, clean, and/or steer the belt as it translates about the plurality of members and an internal pressure member. For example, FIG. 1 shows a belt-roll module 101 including an internal pressure member 120, wherein the belt-roll module 101 is positioned to engage the internal pressure member 120 with the external pressure member 110 of the belt-roll main frame 102. The internal pressure member 120 shown in FIG. 1 is a cylindrical member that is rotatable about longitudinal axis, e.g., a central longitudinal axis 121.

The belt-roll module 101 may include a cleaner member 127 positioned so that the internal pressure member 120 interposes the cleaner member 127 and the external pressure member 110 when the belt-roll module 101 is positioned to engage the internal pressure member 120 with the external pressure member 110 of the main frame of the belt-fuser system 100. The cleaner member 127 may be a rotatable member that facilitates support and translation of a belt. For example, the cleaner member 127 may be a roll, such as a cylindrical roll that is rotatable about its central longitudinal axis. The cleaner roll 127 may be associated with, for example, a web cleaning system or a belt cleaning system. A web cleaning system may include a plurality of members that facilitate cleaning of a web or belt of the belt-roll fuser system. The web cleaning system may be customer replaceable, facilitated by, e.g., the latching and unlatching operability of the belt-roll fuser module 101. The internal pressure member 120 may be associated with a metering system. A metering system may include one or more metering members, such as a media roll.

The belt-roll fuser module 101 of FIG. 1 may include a belt member 130. The belt member 130 may be rotatable. For example, the belt member 130 may be a roll, such as a cylindrical roll that is rotatable about its central longitudinal axis. The belt-roll module 130 may include a tension member 133. The tension member 133 may be a roll, such as a cylindrical roll that is rotatable about its central longitudinal axis. The tension member 133 may be associated with a belt tensioner. The tension member 133 may be configured to accommodate belt tracking and steering. Each of the cleaner member 127, the belt member 130, and the tension member 133 may be heated. For example, the tension member 133 may include a heating element 135. One or more of the members of the belt-roll module 101 may be monitored by various monitoring devices 140. For example, the monitoring devices may be thermistors such as contact thermistors.

Each of the internal pressure member 120, thr cleaner member 127, the belt member 130, and the tension member 133 may be configured to entrain a belt 143. The belt 143 may translate about the rotatable members. The belt 143 may be replaceable. For example, the belt-fuser module 101 may be positioned to accommodate access to components of the belt-roll fuser module 102 thereby enabling, e.g., user replacement of the belt 143. Belt thermistors (not shown) may be arranged about the belt 143.

The belt 143 may pass through a nip defined by the internal pressure member 120 of the belt-roll module 101 and the external pressure member 110 when, e.g., the belt-roll module 101 is latched to the main frame 102. Post-fusing processing components may be situated about the nip; specifically, about an exit of the nip. For example, an air knife 145 may be at the exit nip. Other components such as a strip shoe may be situated at the exit nip. An exit sensor 150 may positioned at an exit of the fusing nip. A substrate having a fused image may be carried by a post-fuser transport system 155 after the substrate exits the fusing nip.

A latch point may be located at the central longitudinal axis 121 of the internal pressure member 120. A latch member may be attached to the belt-roll fuser module 101 at the latch point. The latch member may be configured to accommodate movement of the module 101 to engage and disengage the internal pressure member 120 and external pressure member 110. Accordingly, because the latch point is located at about the central longitudinal axis 121 of the internal pressure member 120, the belt-roll module 101 may be latched to the belt-roll fuser main frame 102 so that a nip load path, e.g., nip load path 157, crosses through the latch member attachment point.

Figure 2:
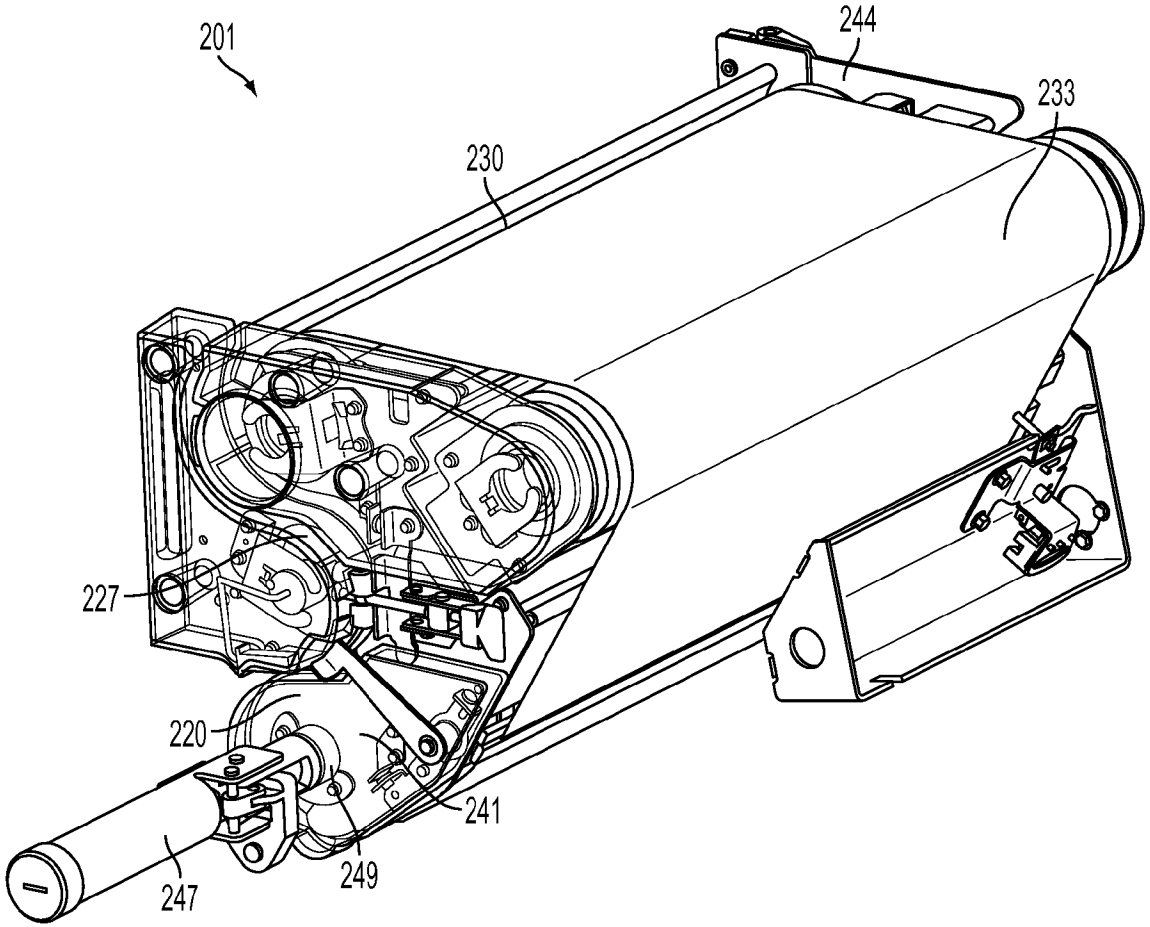
FIG. 2 shows a side perspective view of a belt-roll fuser module in accordance with an exemplary embodiment.

FIG. 2 shows a side perspective view of a belt-roll fuser module in accordance with an exemplary embodiment. The belt-roll fuser module 201 of FIG. 2 may include an internal pressure member 220. The internal pressure member 220 may be configured to rotate about a longitudinal axis that extends about centrally along a length of the internal pressure member 220.

The belt-roll module 201 may include a cleaner member 227. The cleaner member 227 may be configured so that the internal pressure member 220 interposes an external pressure member of a belt-roll fuser system mainframe (not shown in FIG. 2), particularly when the belt-roll module 201 is latched to the main frame, and the internal pressure member 220 is engaged with the external pressure member to define a nip.

The belt-roll module 201 may include a belt member 230, and a tension member 233. A belt may be entrained by the internal pressure member 220, the cleaner member 227, the belt member 230, and the tension member 233. The cleaner member 227, the belt member 230, and/or the tension member 233 may be heated, and may be rotatable about a central longitudinal axis that extends along a length of the member.

The belt-roll module 201 may include a frame, which may support the members of the belt-roll module 201. The frame may comprise a first side frame 241 and a second side frame 244. FIG. 2 shows a first side frame 241 arranged to support at least one of the internal pressure member 220, cleaner member 227, belt member 230, and tension member 233. For example, the first side frame 241 abuts an end of the internal pressure member 220. The second side frame 244 may be arranged to abut an opposite end of the internal pressure member 220. The frame may comprise any shape or form, and any material now known or later developed that is suitable providing a frame, support, and/or attachment points for the members of the belt-roll fuser module 201.

FIG. 2 shows a latching mechanism including a latch member 247. The latch member 247 may include a hinged, cylindrical handle, as shown. The latch member 247 may attached to a portion of a frame of the belt-roll fuser module 201, and may be attached to the internal pressure member 220.

In alternative embodiments, the latching mechanism may include an internal pressure roll having a shaft that rests on v-blocks when the belt module latches. The shaft may lock into place using, e.g., a clamp, cam, locking screw, etc.

Other latching mechanisms may include an internal pressure member having a hollow shaft. Pins may protrude from one or more ends of the shaft, and may do so by way of an internal spring. The pins may be solid pins. When the module is engaged to the main frame, the pins may be configured to lock the module. For example, the pins may be received by bushings attached to the main frame of the belt-roll fuser system when the module is moved to an engaged position. The pins may be retracted by a retract mechanism, which may include handles, cables, or a solenoid mechanism. In further alternative embodiments, an internal pressure roll may include a hollow shaft, and locking pins, which may be located on the main frame, may be configured to interact with the hollow shaft of the internal pressure member when the module is engaged.

In embodiments, the latching mechanism may be a single lever operated latching system that engages and disengages a belt-roll fuser module to a main frame. The latching mechanism may include an in-board and an out-board pin that are actuated by the rotation of a latch member, e.g., a handle. When an operator rotates the handle 90°, the in-board and out-board pins may be disengaged from the pin receptacles. The latch mechanism may be configured so that rotation of the handle locks the handle in a service position. Accordingly the module may be locked in the disengaged position to accommodate servicing of the belt-roll fuser system. To return the module to the engaged and latched positions, the operator may actuate, e.g., a thumb-slide to release the locked handle and allow the handle to be rotated 90° to the operating (latched) position.

FIG. 2 shows a latch point 249 at which the latch member 247 may be attached to the belt-roll fuser module 201. The latch point is located at about a central longitudinal axis of the internal pressure member 220. Such an arrangement allows latching of the belt-roll fuser module 201 to the main frame on the internal pressure member 220 axis, thereby ensuring that the latching point is in the nip load path. For example, the latch point 249 may be located at a point that corresponds to a roll axis of the internal pressure member 220 of FIG. 2. When the latch point 249 is aligned with a pressure roll nip vector, which corresponds to a nip load path, the potential for twisting or deformation of the belt module may be reduced. For example, the moment and resulting twisting on the belt module due to nip load may be substantially reduced.

Figure 3:
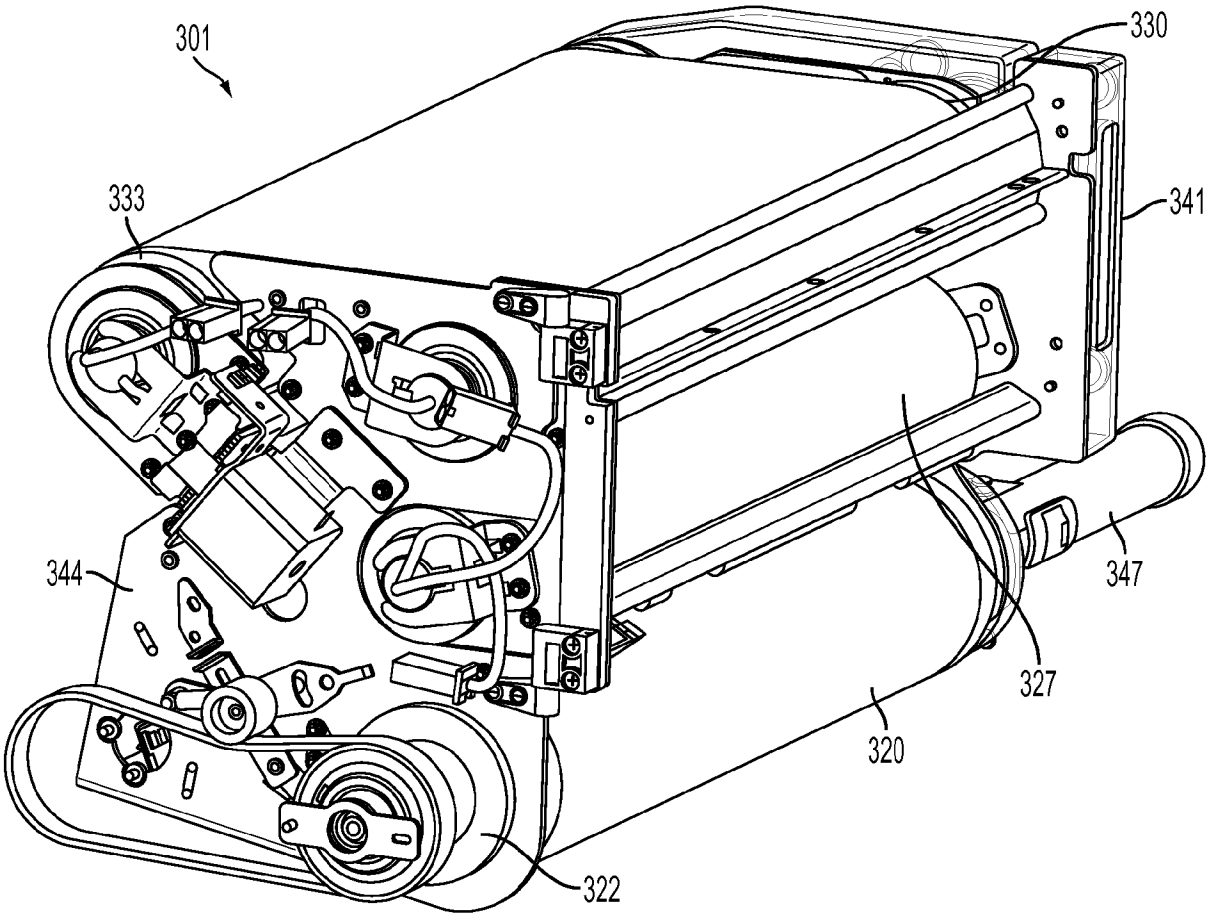
FIG. 3 shows a side perspective view of a belt-roll fuser module in accordance with an exemplary embodiment.

FIG. 3 shows a perspective view of a belt-roll fuser module 301 in accordance with an exemplary embodiment. The belt-roll fuser module 301 of FIG. 3 may include an internal pressure member 320. The internal pressure member 320 may be configured to rotate about a longitudinal axis that extends about centrally along a length of the internal pressure member 320.

The belt-roll module 301 may include a cleaner member 327. The cleaner member 327 may be configured so that the internal pressure member 320 interposes an external pressure member of a belt-roll fuser system mainframe (not shown in FIG. 3) and the cleaner member 327, particularly when the belt-roll module 301 is latched to the main frame, and the internal pressure member 320 is engaged with the external pressure member to define a nip.

The belt-roll module 301 may include a belt member 330, and a tension member 333. A belt may be entrained by the internal pressure member 320, the cleaner member 327, the belt member 330, and the tension member 333. The cleaner member 327, the belt member 330, and/or the tension member 333 may be heated, and may be rotatable about a central longitudinal axis that extends along a length of the member.

The belt-roll module 301 may include a frame, which may support the members of the belt-roll module 301. The frame may comprise a first side frame 341 and a second side frame 344. FIG. 3 shows a first side frame 341 arranged to support at least one of the internal pressure member 320, cleaner member 327, belt member 330, and tension member 333. For example, in FIG. 3, the first side frame 341 is arranged at a first side of the rotatable members; the first side frame 341 abuts an end of the internal pressure member 320. Similarly, the second side frame 344 may be arranged to abut an opposite end of the internal pressure member 320. The frame may comprise any shape or form, and any material now known or later developed that is suitable providing a frame, support, and/or attachment points for the members of the belt-roll fuser module 301.

FIG. 3 shows a latch member 347. The latch member 347 may include a hinged, cylindrical handle, as shown. In alternative embodiments, the latching mechanism may include an internal pressure roll having a shaft that rests on v-blocks when the belt module latches. The shaft may lock into place using, e.g., a clamp, cam, locking screw, etc.

Other latching mechanisms may include an internal pressure member having a hollow shaft. Pins may protrude from one or more ends of the shaft, and may do so by way of an internal spring. The pins may be solid pins. When the module is engaged to the main frame, the pins may be configured to lock the module. For example, the pins may be received by bushings attached to the main frame of the belt-roll fuser system when the module is moved to an engaged position. The pins may be retracted by a retract mechanism, which may include handles, cables, or a solenoid mechanism. In further alternative embodiments, an internal pressure roll may include a hollow shaft, and locking pins, which may be located on the main frame, may be configured to interact with the hollow shaft of the internal pressure member when the module is engaged.

In embodiments, the latching mechanism may be a single lever operated latching system that engages and disengages a belt-roll fuser module to a main frame. The latching mechanism may include an in-board and an out-board pin that are actuated by the rotation of a latch member, e.g., a handle. When an operator rotates the handle 90°, the in-board and out-board pins may be disengaged from the pin receptacles. The latch mechanism may be configured so that rotation of the handle locks the handle in a service position. Accordingly the module may be locked in the disengaged position to accommodate servicing of the belt-roll fuser system. To return the module to the engaged and latched positions, the operator may actuate, e.g., a thumb-slide to release the locked handle and allow the handle to be rotated 90° to the operating (latched) position.

The latch member 347 may be attached at a point that corresponds with about a central longitudinal axis of the internal pressure member 320, i.e., a rotational axis of the internal pressure member 320. Such an arrangement allows latching of the belt-roll fuser module 301 to the main frame on the internal pressure member 320 axis, which ensures that the latching point is in the nip load path. For example, the latch point may be located at point that corresponds to the roll axis of the internal pressure member 320 of FIG. 3. When the latch point is aligned with a pressure roll nip vector, which corresponds to a nip load path, the potential for twisting or deformation of the belt module when engaged with the main frame may be reduced. For example, the moment and resulting twisting on the belt module due to nip load may be substantially reduced.

Based on a modeling study of belt-roll fuser tracking, it was concluded that roll-to-roll alignments should be kept within certain tolerances to minimize assembly misalignments and belt roll module frame distortion or deformation misalignments. The belt-roll fuser module used for the test included an internal pressure member having a central longitudinal axis or rotational axis, i.e., roll-bearing center. The tested belt-roll fuser included a cleaner roll positioned above the internal pressure roll with respect to a bottom of the belt-roll fuser module (i.e., the portion of the module nearest the main frame of the belt roll fuser when the belt roll fuser module is latched to the main frame). The cleaner roll interposed the internal pressure roll and a belt roll. A latch was located near the internal pressure member of the belt roll fuser module.

The modeling study combined A PROPIETARY TRACKING MODEL modeling with an Expected Value Analysis to optimize tracking performance and limit costs. For example, keeping the roll bearing centers within tighter tolerances increases costs. Based on the study, it was found that belt member and cleaner member roll alignments should be kept within +/−0.5 mm. It was found that the cleaner member should be kept within a tolerance of +/−0.25 mm in a hard direction. For example, with illustrative reference to the exemplary cleaner member 327 of FIG. 3, it was found that a cleaner member should be kept within a tolerance of +/−0.25 mm in a hard direction, i.e., from the central longitudinal axis of the rotatable cleaner member 327 toward the bare belt entraining surface of the cleaner member 327 that is visible in FIG. 3. It was also found that a steering member should be kept with a +/−0.5 mm tolerance from a center or play, e.g., a rotational longitudinal axis of the steering member.

The tested belt-roll fuser was configured to track a fuser belt back and forth in an absence of a nip load, and the latch was located close to the internal pressure member. When an external pressure roll was cammed-in, it was apparent that the frame twisted, distorted, an/or deformed due to the nip load creating a moment, and the fuser belt walked continuously despite the steering member being configured to steer the fuser belt with its largest steering angle. The belt module twist influence on tracking was modeled using a proprietary tracking model and is it was found that without any other source of misalignment, the latitude to track the belt back and forth would be marginal. Thus, any other source of misalignment beyond roll-to-roll misalignment may eliminate tracking altogether.

Figure 4:
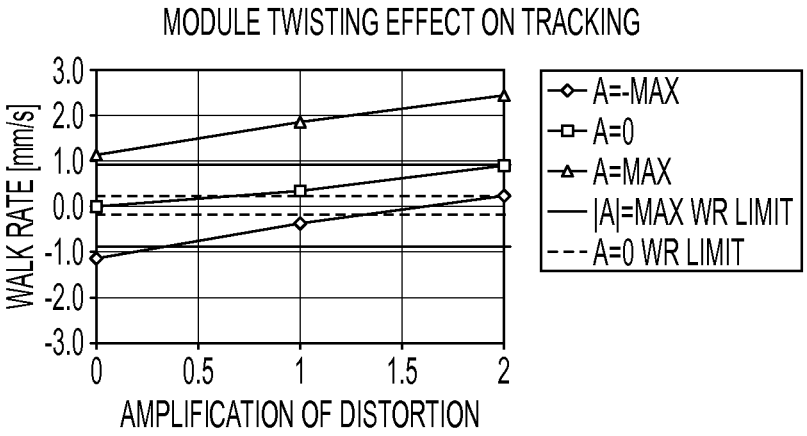
FIG. 4 shows a graph depicting results of observations of module twisting effect on tracking.

By having a belt roll module latch to a mainframe on an internal pressure member central longitudinal axis in accordance with embodiments, the nip load path crosses through the latch point, substantially minimizing or eliminating frame twisting. Data showing the effect on belt module tracking by twisting due to pressure member load is depicted in FIG. 4. Specifically, FIG. 4 shows module twisting effect on tracking based on amplification of distortion versus walk rate. According to FIG. 4, even with a substantially perfectly aligned belt-roll fuser module and the measured module distortion, belt tracking may be off. Amplification of actual distortions by 50% eliminates the ability to track the belt, and the belt will continuously walk. To ensure proper tracking, the distortion should be reduced to less than about 0.25 mm, for example. Latching the belt module to the frame by way of a latch point located at about a central longitudinal axis of the internal pressure member, or at a point whereby the nip load path crosses through the latch point in accordance with exemplary embodiments, frame twisting came be minimized.

While methods, apparatus, and systems for latching a belt-roll fuser module to a main frame of a belt-roll fuser are described in relationship to exemplary embodiments, many alternatives, modifications, and variations would be apparent to those skilled in the art. Accordingly, embodiments of the methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A belt-roll fuser system, comprising:

a belt-roll fuser module, the belt-roll fuser module having an internal pressure member, the belt-roll fuser module being movable to bring the internal pressure member into engagement and disengagement with an external pressure member, the internal pressure member defining a nip when engaged; and a latch member being selectively engageable with a latch point on the belt-roll fuser module, the latch point being located in a path of a load vector of the nip when the internal pressure member is engaged; and the latch member comprising a handle being connected via a hinge to an engaging portion which latches with the latch point on the internal pressure member; and the hinge axis being substantially perpendicular to a longitudinal axis of the internal pressure member.

2. The belt-roll fuser system of claim 1, the belt-roll fuser module further comprising at least one heated belt entraining member.

3. The belt-roll fuser system of claim 1, the system further comprising:

a belt-roll fuser main frame having the external pressure member, the nip being defined by the external pressure member and the internal pressure member when the internal pressure member is engaged.

4. The belt-roll fuser system of claim 1, wherein the handle is an elongated handle.

5. A customer serviceable belt-roll fuser, comprising:

a belt-roll fuser module having an internal pressure member, the belt-roll fuser module being movable to engage and disengage with an external pressure member, wherein when the belt-roll fuser module is engaged, the internal pressure member defines a fusing nip;

a latch for moving the belt-roll fuser module to engage and disengage said module with the external pressure member, the latch being located on a central longitudinal axis on the internal pressure member;

the latch comprising a handle being connected via a hinge to an engaging portion which latches with a latch point on the internal pressure member; and the hinge axis being substantially perpendicular to a central longitudinal axis of the internal pressure member.

6. The belt-roll fuser of claim 5, further comprising:

a belt-roll fuser main frame having the external pressure member that defines the fusing nip with the internal pressure member when the belt-roll fuser module is engaged to the belt-roll fuser main frame.

7. The belt-roll fuser of claim 5, the belt-roll fuser module further comprising:

at least one of a belt member, a cleaner member, and a tension member.

8. The belt-roll fuser of claim 7, further comprising at least one of the belt member, the cleaner member, and the tension member being heated.

9. The belt-roll fuser of claim 7, wherein the belt member, the cleaner member, and the tension member are rotatable cylindrical rolls.

10. The belt-roll fuser of claim 5, wherein the internal pressure member is a cylindrical roll that rotates about the central longitudinal axis.

11. The belt-roll fuser of claim 5, the latch being attached to the belt-roll fuser module at the latch point, the latch point being located on about the central longitudinal axis of the internal pressure member.

12. The belt-roll fuser of claim 11, wherein when the belt-roll fuser module is engaged to the belt-roll fuser main frame whereby the internal pressure member and the external pressure member define the fusing nip, a nip load vector crosses through the latch point.

* * * * *